US011776709B2

(12) United States Patent
Dong et al.

(10) Patent No.: US 11,776,709 B2
(45) Date of Patent: Oct. 3, 2023

(54) FLEXIBLE CONDUCTIVE PASTE AND FLEXIBLE ELECTRONIC DEVICE

(71) Applicant: Beijing Dream Ink Technologies Co., Ltd., Beijing (CN)

(72) Inventors: Shijin Dong, Beijing (CN); Zhenlong Men, Beijing (CN)

(73) Assignee: Beijing Dream Ink Technologies Co., Ltd., Beijing (CN)

( * ) Notice: Subject to any disclaimer, the term of this patent is extended or adjusted under 35 U.S.C. 154(b) by 0 days.

(21) Appl. No.: 17/622,710

(22) PCT Filed: Apr. 12, 2021

(86) PCT No.: PCT/CN2021/086631
§ 371 (c)(1),
(2) Date: Dec. 24, 2021

(87) PCT Pub. No.: WO2021/208858
PCT Pub. Date: Oct. 21, 2021

(65) Prior Publication Data

US 2022/0254541 A1 Aug. 11, 2022

(30) Foreign Application Priority Data

Apr. 17, 2020 (CN) ..... 202010302490.6

(51) Int. Cl.
*H01B 1/22* (2006.01)

(52) U.S. Cl.
CPC ..... *H01B 1/22* (2013.01)

(58) Field of Classification Search
CPC ..... H01B 1/00; H01B 1/20; H01B 1/22
See application file for complete search history.

(56) References Cited

U.S. PATENT DOCUMENTS 5,328,087 A * 7/1994 Nelson ..... C09J 9/02 361/779
7,306,823 B2 * 12/2007 Sager ..... B22F 1/056 977/773

(Continued)

FOREIGN PATENT DOCUMENTS

CN 101717557 A 6/2010
CN 5307670 B2 10/2013

(Continued)

OTHER PUBLICATIONS

Liu et al. "Oxide rupture-induced conductivity in liquid metal nanoparticles by laser and thermal sintering", Nanoscale, 2019, 11, 17615.*

(Continued)

*Primary Examiner* — Mark Kopec
(74) *Attorney, Agent, or Firm* — Weaver Austin Villeneuve & Sampson LLP

(57) ABSTRACT

A flexible conductive paste and a flexible electronic device are provided, which relate to the technical field of new materials. The flexible conductive paste includes: 3% to 7% by weight of a film former; 20% to 50% by weight of a conductive powder; 25% to 45% by weight of a liquid metal microcapsule; 10% to 30% by weight of a solvent; 0.1% to 5% by weight of a curing agent; and 0.5% to 5% by weight of a functional additive. The wall of the liquid metal microcapsule is a coating resin, the core of the liquid metal microcapsule is a liquid metal. The melting point Tm of the liquid metal satisfies Tm≤T1. The film former has a molecular weight within a range of 15000 to 30000, and has a glass transition temperature Tg smaller than or equal to T1. T1 is a temperature at which the flexible conductive circuit manufactured by the flexible conductive paste is deformed. The (Continued)

flexible conductive circuit of the present disclosure can have better conductivity and better flexibility simultaneously.

15 Claims, 1 Drawing Sheet

(56) References Cited

U.S. PATENT DOCUMENTS

| | | | | |
|---|---|---|---|---|
| 10,937,716 | B2 * | 3/2021 | Rykaczewski | H01L 23/3737 |
| 2005/0228097 | A1 * | 10/2005 | Zhong | B82Y 30/00 524/439 |
| 2017/0062374 | A1 * | 3/2017 | Chu | H01L 23/5328 |
| 2018/0305563 | A1 * | 10/2018 | Oh | C09D 133/02 |
| 2018/0354037 | A1 * | 12/2018 | Thuo | B22F 10/20 |
| 2022/0262538 | A1 * | 8/2022 | Li | H01B 1/22 |
| 2022/0367524 | A1 * | 11/2022 | Park | H01B 5/14 |

FOREIGN PATENT DOCUMENTS

| | | | |
|---|---|---|---|
| CN | 110729071 | A | 1/2020 |
| WO | WO 2021/208858 | A1 | 10/2021 |

OTHER PUBLICATIONS

International Search Report dated Jul. 1, 2021 issued in PCT Application No. PCT/CN2021/086631.

* cited by examiner

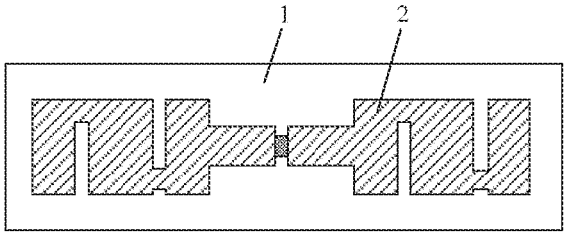
1
2

FLEXIBLE CONDUCTIVE PASTE AND FLEXIBLE ELECTRONIC DEVICE

CROSS-REFERENCE TO RELATED APPLICATIONS

The present application claims priority to Chinese Patent Disclosure No. 2020103024906, titled with "flexible conductive paste and flexible electronic device" and filed on Apr. 17, 2020, the content of which is incorporated herein by reference in its entirety.

TECHNICAL FIELD

The present disclosure relates to the field of new materials, and, particularly, relates to a flexible conductive paste and a flexible electronic device.

BACKGROUND

In recent years, with rapid development of electronic information technology, the market has become increasingly demanding on the specificity and functionality of conductive pastes. In order to meet the above requirements, the conductive paste has gradually developed from a single material, such as metal and carbon, to a composite conductive paste. The composite conductive paste is mostly made of solid conductive media and carrier materials. For example, it is composited by combining conductive particles such as silver powder, copper powder, carbon powder, graphene, etc. with an epoxy resin, an acrylic resin, a polyurethane resin, a vinyl chloride-vinyl acetate copolymer resin, and a silicone resin.

Moreover, with continuous development of flexible electronic information technology and wearable electronic devices, functional materials with both flexibility and conductivity have attracted more and more attention in the industry. The applicant found that the electrical conductivity of the above-mentioned composite conductive pastes in the related art can mostly meet the requirements, but it is difficult to have good bending resistance and tensile resistance, such that it cannot meet requirements for high flexibility (such as, bending resistance, tensile resistance, distortion resistance) of flexible electronic products after the conductive paste is formed.

SUMMARY

The present disclosure provides a flexible conductive paste and a flexible electronic device, which can cause a flexible conductive circuit to have better conductivity and better flexibility simultaneously.

In a first aspect of the present disclosure, a flexible conductive paste is provided, which adopts following technical solutions.

The flexible conductive paste includes: 3% to 7% by weight of a film former; 20% to 50% by weight of a conductive powder; 25% to 45% by weight of a liquid metal microcapsule; 10% to 30% by weight of a solvent; 0.1% to 5% by weight of a curing agent; and 0.5% to 5% by weight of a functional additive. A wall of the liquid metal microcapsule is a coating resin, a core of the liquid metal microcapsule is a liquid metal. The liquid metal has a melting point $Tm \leq T1$. The film former has a molecular weight within a range of 15000 to 30000, and has a glass transition temperature Tg smaller than or equal to T1. T1 is a temperature at which the flexible conductive circuit made of the flexible conductive paste is deformed.

Optionally, the film former is an amorphous polymer.

Optionally, the film former contains a hydroxyl active group with a hydroxyl value within a range of 3 mg KOH/g to 8 mg KOH/g.

Optionally, the film former has a viscous flow temperature higher than 120° C.

Further, the film former is a saturated polyester resin having a glass transition temperature lower than −18° C. and a viscous flow temperature higher than 140° C.

Optionally, the conductive powder is a mixture of a flake silver powder and a spherical silver powder; and a mass ratio of the flake silver powder to the spherical silver powder in the conductive powder is (0.5 to 3):1.

Optionally, the functional additive includes one or more of a thixotropic agent, a viscoelastic modifier and a polar additive.

Optionally, the liquid metal microcapsule has a diameter within a range of 3 μm to 10 μm.

Optionally, a weight ratio of the coating resin to the liquid metal in the liquid metal microcapsule is within a range of 1:(2-10).

Optionally, a weight ratio of the coating resin to the liquid metal in the liquid metal microcapsule is within a range of 1:(4-8).

Optionally, the liquid metal microcapsules further include an organic silicon additive.

Optionally, the weight ratio of the silicone additive to the coating resin is within a range of 1:(5-10).

In a second aspect of the present disclosure, a flexible electronic device is provided, which adopts following technical solutions.

The flexible electronic device includes a flexible substrate and a flexible conductive circuit, and the flexible conductive circuit is made of the flexible conductive paste described in any one of the above items.

Optionally, the flexible substrate has a surface tension within a range of 20 mN/m to 50 mN/m.

Optionally, the flexible substrate is a polypropylene film, a polyethylene film, a thermoplastic polyurethane elastomer rubber film, a polyamide film, an ethylene-vinyl acetate copolymer film, polyurethane fiber, polyester fiber, a finished hot melt adhesive film, or a flexible film material pre-coated with a resin or an adhesive.

The present disclosure provides a flexible conductive paste and flexible electronic devices. Since the flexible conductive paste includes a film former, a conductive powder, a liquid metal microcapsule, a solvent, a curing agent and a functional additive. On the one hand, when the flexible conductive circuit is deformed, the liquid metal microcapsule will deform and break, and the coated liquid metal is released. Since the liquid metal is in a liquid state and has better fluidity and deformability, the liquid metal can fill a conductive path, thereby causing the flexible conductive circuit to be more flexible. On the other hand, when the flexible conductive circuit is deformed, the film former is in a high elastic state, such that the flexible conductive circuit is more flexible. On the other hand, the molecular weight of the film former is in a range from 15,000 to 30,000, which can obtain a better electrical performance of the flexible conductive paste. Therefore, the flexible conductive circuit made of the flexible conductive paste provided by the present disclosure has better conductivity and better flexibility.

BRIEF DESCRIPTION OF DRAWINGS

In order to more clearly explain some embodiments of the present disclosure or the technical solution in the related art, the drawings used in the description of the embodiments or the related art will be briefly described below. The drawings in the following description are some embodiments of the present disclosure. Those skilled in the art may obtain other drawings based on these drawings.

The Drawings is a structural schematic view showing a flexible electronic device according to an embodiment of the present disclosure.

DESCRIPTION OF EMBODIMENTS

In order to more clearly illustrate objects, technical solutions and advantages of embodiments of the present disclosure, the technical solutions in some embodiments of the present disclosure are clearly and completely described below with reference to the accompanying drawings in some embodiments of the present disclosure. The described embodiments are merely part of the embodiments of the present disclosure rather than all of the embodiments. All other embodiments obtained by a person skilled in the art shall fall into the scope of the present disclosure.

It should be noted that various technical features in embodiments of the present disclosure can be combined with one another if there is no conflict.

An embodiment of the present disclosure provides a flexible conductive paste. Calculated by weight percentage, the flexible conductive paste includes 3% to 7% by weight of a film former, 20% to 50% by weight of a conductive powder, 25% to 45% by weight of a liquid metal microcapsule, 10% to 30% by weight of a solvent, 0.1% to 5% by weight of a curing agent and 0.5% to 5% by weight of a functional additive. The capsule wall of the liquid metal microcapsule is a coating resin, the core of the liquid metal microcapsule is a liquid metal, and the melting point Tm of the liquid metal satisfies $Tm \leq T1$. The film former has a molecular weight of 15,000 to 30,000, and has a glass transition temperature Tg satisfying $Tg \leq T1$, in which T1 is a temperature when the flexible conductive circuit made of flexible conductive paste is deformed.

With the above limitations on the melting point Tm of the liquid metal and the glass transition temperature Tg of the film former, at least when the flexible conductive circuit is deformed, the liquid metal is in a liquid state, and the film former is in a high elastic state. It should be noted that, the high elastic state means that the deformation can be completely recovered after the external force is removed, also known as a high-elastic deformation, which includes following cases.

In the first case, a normal operating (i.e. without significant deformation) temperature T2 of the flexible conductive circuit is the same as the temperature T1 when it is deformed, the melting point Tm of the liquid metal and the glass transition temperature Tg of the film former should be lower than the above temperature T1 or T2, such that when the flexible conductive circuit is deformed, the liquid metal is in a liquid state and the film former is in a high elastic state.

In the second case, the normal operating temperature T2 of the flexible conductive circuit is higher than the temperature T1 when it is deformed, the melting point Tm of the liquid metal and the glass transition temperature Tg of the film should be lower than the above temperature T1, such that when the flexible conductive circuit is deformed, the liquid metal is in a liquid state and the film former is in a high elastic state.

In the third case, the normal operating temperature T2 of the conductive circuit is lower than the temperature T1 when it is deformed, the melting point Tm of the liquid metal and the glass transition temperature Tg of the film should be lower than the above temperature T1, such that when the flexible conductive circuit is deformed, the liquid metal is in a liquid state and the film former is in a high elastic state. In this way, when the flexible conductive circuit is operated normally, the liquid metal can be in a liquid or solid state, and the film former can be in a high elastic state or in a glass state. The glass state refers to a solid state in which an object retains glass-like characteristics.

For example, the flexible conductive circuit is an antenna in a water-washed electronic tag. The normal operating temperature of the flexible conductive circuit is the room temperature. It needs to be deformed when it is industrially washed or washed by a washing machine. The washing temperature is higher than room temperature, as long as the liquid metal is in a liquid state and the film former is in a high elastic state when the water-washed electronic tag is washed. That is, the melting point Tm of the liquid metal and the glass transition temperature Tg of the film former can both be lower than the washing temperature and higher than room temperature, or both lower than room temperature, or one of the melting point Tm of the liquid metal and the glass transition temperature Tg of the film former is lower than the washing temperature and higher than room temperature, and the other of the melting point Tm of the liquid metal and the glass transition temperature Tg of the film former is lower than room temperature.

For another example, the flexible conductive circuit is an antenna in a water-washed electronic tag. The normal operating temperature of the flexible conductive circuit is the room temperature. It needs to be deformed when it performs ordinary water washing. The water temperature during washing is lower than room temperature. It is necessary to ensure that the liquid meal is in a liquid state and the film former is in a high elastic state when it is washed. That is, the melting point Tm of the liquid metal and the glass transition temperature Tg of the film former each should be lower than the water temperature during washing.

It should be noted that when the glass transition temperature Tg of the film former is lower than the temperature T1 by 25° C. to 30° C., in the environment at temperature T1, chain segments of the film former are more flexible, and have a better transfer ability, such that it is less prone to brittle failure under an action of an external force.

The flexible conductive circuit made of the flexible conductive paste provided by the present disclosure has good flexibility and good conductivity. On the one hand, when the flexible conductive circuit is deformed, the liquid metal microcapsule will deform and break, and the coated liquid metal is released. Since the liquid metal is in a liquid state and has better fluidity and deformability, the liquid metal can fill a conductive path, thereby causing the flexible conductive circuit to be more flexible. On the other hand, when the flexible conductive circuit is deformed, the film former is in a high elastic state, such that it has good stretch ability and excellent bending and twisting capabilities. On the other hand, the molecular weight of the film former is in a range from 15,000 to 30,000, which can obtain a better electrical performance of the flexible conductive paste. If the molecular weight of the film former is excessively small (i.e., less than 15000), the amount of the conductive powder adsorbed by the film former cannot be guaranteed, such that the number of "bonding bridge" among the conductive powders cannot be guaranteed, and an efficient thickening effect cannot be obtained in the case of a certain solvent content. If the molecular weight of the film former is excessively large (i.e., more than 30,000), the volume of the shrinking segment will be excessively large during a curing process of the flexible conductive circuit, which may hinder further gathering of the conductive powder and increase the contact resistance and tunnel resistance between the conductive powders.

Exemplarily, in some embodiments of the present disclosure, a weight content of the film former in the flexible conductive paste is 3%, 4%, 5%, 6%, or 7%. A weight content of the conductive powder in the flexible conductive paste is 20%, 30%, 40% or 50%. A weight content of the liquid metal microcapsules in the flexible conductive paste is 25%, 30%, 35%, 40% or 45%. A weight content of the solvent in the flexible conductive paste is 10%, 15%, 20%, 25% or 30%. A weight content of the curing agent in the flexible conductive paste is 0.1%, 0.5%, 1%, 2%, 3%, 4% or 5%. A weight content of the functional additive in the flexible conductive paste is 0.5%, 1%, 2%, 3%, 4% or 5%.

It should be emphasized that the weight content of the solvent in the flexible conductive paste provided by the present disclosure is higher than that of an ordinary conductive paste, which can play a role in reducing the frictional resistance among the film formers, among the conductive powders, and among the conductive powders and the film formers. The film formers and conductive powders is easy to be oriented under a stretching action of the screen printing process, such that the breaking strength of the flexible conductive paste can be reduced, and the flexible conductive paste is more likely to be broken, thereby achieving no obvious wire drawing.

The specific contents of various components in the flexible conductive paste will be illustrated by following examples of the present disclosure.

In some embodiments of the present disclosure, the film former contains hydroxyl active groups, such that it can be cross-linked by the curing agent. Furthermore, the applicant found that if the hydroxyl value of the film former is excessively high, on the one hand, the wrapping degree of the conductive powder will be excessively high, such that the flexible conductive circuit has a reduced conductivity and excellent hydrophilicity (i.e., water permeability), thereby reducing the strength and dimensional stability of the flexible conductive circuit by hydrolyzing. Furthermore, when the flexible conductive circuit is applied in the water-washed electronic label, it is more prone to aging under the action of chemicals such as detergents. On the other hand, a larger crosslinking density may cause the flexible conductive circuit to be excessively hard and become brittle after printing to form a film, and it is easy to produce stress cracking when the flexible conductive circuit is subjected to an external force. If the hydroxyl value is excessively low, it is more difficult to achieve a better crosslinking density, and the modulus of the film former is excessively low, it is easy to produce a large-scale deformation to break the conductive path under an action of an external force. Moreover, sine the conductive powder has a poor ability to disperse and wrap, during the curing process of the flexible conductive circuit, it is difficult to assist the effective arrangement of the conductive powder in the process of shrinking the size of the film former as the solvent is volatilized.

In view of this, in some embodiments of the present disclosure, the film former has a hydroxyl value within a range of 3 mg KOH/g to 8 mg KOH/g, e.g., 3 mg KOH/g, 4 mg KOH/g, 5 mg KOH/g, 6 mg KOH/g, 7 mg KOH/g or 8 mg KOH/g. The hydroxyl value refers to milligrams of potassium hydroxide (KOH) equivalent to the hydroxyl group in 1 g sample.

Furthermore, in some embodiments of the present disclosure, the weight percentages of the film former and the curing agent can satisfy that when the film former in above hydroxyl value range and the curing agent undergo a cross-linking reaction, all hydroxyl groups in the film former react with the curing agent, i.e., the reactive groups (e.g., isocyanato group) in the curing agent are slightly excessive relative to the active hydrogen in the film former, thereby achieving a suitable crosslinking degree while improving the chemical stability of the flexible conductive circuit.

In addition, the applicant found that the crystallinity of the film former has a significant impact on the solubility of the film former, the processing difficulty and storage properties of the flexible conductive paste. In some embodiments of the present disclosure, amorphous polymers, such as an amorphous saturated polyester resin, are selected such that the film former has better overall performance in various aspects.

The applicant further found that under the existing cross-linking conditions (corresponding to the hydroxyl value of the film former previously defined), the viscous flow temperature of the film former (before cross-linking) has an impact on the damage resistance of the flexible conductive circuit at a higher temperature. For example, the flexible conductive circuit in the water-washed electronic label is washed by water at a higher temperature, or, in a rapid drying process at high temperature, if the initial viscous flow temperature of the film former is much lower than the above temperature (e.g., a difference of 40° C.), the chain segments of the film formers can move freely, such that when the flexible conductive circuit is deformed, the flexible conductive circuit may be short-circuited or disconnected, which restricts the application of the flexible conductive circuit. Based on the above content, in some embodiments of the present disclosure, the viscous flow temperature of the film former is selected to be higher than 120° C. In addition, the viscous flow temperature can further prevent the aged deterioration of the film former of the flexible conductive circuit during a high-temperature baking process.

Furthermore, after comprehensively considering the glass transition temperature and viscous flow temperature of the film former, in some embodiments of the present disclosure, the film former is selected to be a saturated polyester resin with a glass transition temperature lower than −18° C. and a viscous flow temperature higher than 140° C., e.g., a polyester elastomer with a glass transition temperature lower than −18° C. and a viscous flow temperature higher than 140° C.

In some embodiments of the present disclosure, the conductive powder can be silver powder, copper powder, silver-coated copper powder, gold powder, or aluminum powder, and its shape can be any of a spherical shape, flake shape, dendritic shape, rod shape, linear shape. For example, in some embodiments of the present disclosure, the conductive powder includes one or more of spherical silver powder, flake silver powder, and silver nanowire. Furthermore, in some embodiments of the present disclosure, the conductive powder is a mixture of flake silver powder and spherical silver powder. In this way, it can overcome two following problems: firstly, when only the flake silver powder is used as the conductive powder, since an contact area of the flake silver power is large, a yield stress is large accordingly, such that it is difficult to generate a necessary elastic deformation, and cracks or even breakage occurs in the flexible conductor; secondly, when only the spherical silver powder is used as the conductive powder, when it is required to achieve predetermined conductivity, a filling amount of silver powder is significantly increased, such that a "pigment to binder ratio" (i.e., a ratio of the silver powder to the film former) is excessively high, causing local stress concentration and damage; and if the contact area of the spherical powder is excessively small, a significant resistance variation is generated during stretching and twisting.

Further, in the conductive powder, a mass ratio of the flake silver powder to the spherical silver powder is (0.5-3):1, such that the flexible conductive circuit can achieve a best comprehensive effect in the above several aspects. For example, the mass ratio of flake silver powder to spherical silver powder can be 0.5:1, 1:1, 1.5:1, 2:1, 2.5:1, or 3:1. Certainly, the mass ratio of flake silver powder to spherical silver powder can be other values within the above range, which is not limited here.

In some embodiments of the present disclosure, the liquid metal in the liquid metal microcapsules may be a gallium indium alloy, a gallium tin alloy, a gallium element, a gallium indium tin alloy, or a gallium indium tin zinc alloy. Those skilled in the art can choose a suitable melting point of the liquid metal according to actual requirements.

In some embodiments of the present disclosure, the liquid metal microcapsules have a diameter within a range of 3 μm to 10 μm. In this way, the liquid metal microcapsules at a bending part can be better broken under a bending force, such that it can fill a large number of gaps formed between the conductive powders formed by the external force. Therefore, the resistance variation of the flexible conductive circuit can be reduced upon bending, and the liquid metal microcapsules can be uniformly distributed in the flexible conductive circuit, thereby avoiding or alleviating premature destruction of the liquid metal microcapsules during the forming process. For example, the diameter of the liquid metal microcapsule may be 3 μm, 4 μm, 5 μm, 6 μm, 7 μm, 8 μm, or 10 μm, which are not limited herein.

In some embodiments of the present disclosure, in the liquid metal microcapsules, a weight ratio of the coating resin to the liquid metal is 1:(2-10), e.g., 1:(4-8), such that the amount of coating resin is suitable, and the thickness of the coating layer formed is moderate. Therefore, the liquid metal microcapsules have better stability, the liquid metal microcapsules can be better broken to compensate resistance variation better when the flexible conductive circuit is bent, and the flexible conductive paste has better conductivity.

In addition, in some embodiments of the present disclosure, the liquid metal microcapsules may further include a silicone additive. Since the silicone additive has a large molecular flexibility, the large-size gap formed by more rigid coating resin when it coats the liquid metal, improving the coating rate of the liquid metal microcapsules. In addition, the silicone additive can provide certain flexibility to significantly reduce the probability that the liquid metal is broken by the microcapsules during the printing process. In some embodiments of the present disclosure, a weight ratio of the silicone additive to the coating resin is 1:(5-10), such that the silicone additive can better achieve the above functions and the liquid metal microcapsules can have good mechanical properties.

In some embodiments of the present disclosure, the coating resin of the liquid metal microcapsules includes one or more of polyester resin, melamine resin, chlorine vinegar resin, vinyl chloride vinyl acetate resin, silicone resin, gelatin, sodium alginate, polyvinylpyrrolidone, chitosan, polyurethane resin, polyacrylic resin, vinyl chloride vinyl acetate resin, epoxy resin, fluorocarbon resin, epoxy acrylic resin, epoxy acrylate resin, polyester acrylate resin, phenolic resin, nitrocellulose, ethyl cellulose, alkyd resin, amino resin, vinyl chloride-vinyl acetate copolymer resin, hydroxyl-modified vinyl chloride-vinyl acetate copolymer resin, thermoplastic polyurethane resin, isocyanate with blocking group and its oligomer.

In some embodiments of the present disclosure, the solvent may include one or more of water, ethyl acetate, butyl acetate, isoamyl acetate, n-butyl glycolate, ethylene glycol butyl ether acetate, diethylene glycol butyl ether acetate, diethylene glycol ethyl ether acetate, butyl acetate, petroleum ether, acetone, methyl ethyl ketone, cyclohexanone, methyl isobutyl ketone, diisobutyl ketone, isophorone, toluene, xylene, butyl carbitol, alcohol ester 12, dibasic acid ester mixture (DBE), ethylene glycol butyl ether, ethylene glycol ethyl ether, dipropylene glycol methyl ether, dipropylene glycol butyl ether, propylene glycol phenyl ether, triethylene glycol methyl ether, n-hexane, cyclohexane, n-heptane, n-octane, isooctane and the like. In actual application, solvents with different boiling points can be mixed as a mixture solvent. Mixture solvents with different surface tensions can significantly inhibit the aggregation of conductive powders, blistering caused by poor compatibility, shrinkage holes during printing, and pinning phenomenon.

In some embodiments of the present disclosure, the curing agent may be isocyanate or its oligomers, e.g., isocyanate with blocked groups or its oligomers. In some embodiments of the present disclosure, the curing agent is m-xylylene isocyanate, or hydrogenated m-xylylene isocyanate.

In some embodiments of the present disclosure, the functional additive includes one or more of a thixotropic agent, a viscoelastic modifier, and a polar additive.

In the presence of the thixotropic agent, the flexible conductive paste has a higher viscosity under the low-shear state so as to achieve the stability and accuracy of the printed graphics during the printing process, and exhibits a relatively high viscosity under the high-shear state so as to facilitate processing. The thixotropic agent is hydrogenated castor oil dispersion solution, fumed silica, or modified polyamide.

The viscoelastic modifier can adjust the viscoelasticity of the flexible conductive paste to reduce the wire drawing phenomenon of the flexible conductive paste during the printing process, such that it is not prone to break during printing, and the defects such as wire drawing, knuckle tooth, flying ink, and burrs are reduced. The viscoelastic modifier can be a high-molecular-weight acrylic resin solution, a high-molecular-weight polyurethane solution, or a polyphenoxy resin solution. The solvent can be methyl isobutyl ketone, methyl ethyl ketone, or butyl acetate.

The polar additive can be used to improve the bondability between the film former with lower polarity and the conductive powder. The polar additive is a self-made polymer solution, such as solutions of chlorine vinegar resin, polyoxyethylene-polyoxypropylene copolymer, or polyoxyethylene fatty acid ester.

In addition, an aspect of the present disclosure provides a flexible electronic device. The Drawing is a structural schematic view showing a flexible electronic device according to an embodiment of the present disclosure. As shown in the Drawing, the flexible electronic device includes a substrate 1 and a flexible conductive circuit 2. The flexible conductive circuit 2 is made of the flexible conductive paste described above. The flexible electronic device may be any electronic device including a flexible conductive circuit, such as a flexible sensor, a wearable device, a flexible electronic label, and a flexible circuit board (FPC).

In some embodiments of the present disclosure, the flexible substrate 1 has an surface tension within a range of 20 mN/m to 50 mN/m, e.g., 20 mN/m, 25 mN/m, 30 mN/m, 32 mN/m, 35 mN/m, 38 mN/m, 40 mN/m, 45 mN/m or 50 mN/m, which are not limited thereto. In some embodiments of the present disclosure, the flexible substrate 1 has an surface tension within a range of 30 mN/m to 40 mN/m, which not only enables the flexible conductive paste to be well wetted and spread on the flexible substrate 1, but also enables the pattern of the flexible conductive circuit obtained through the molding process to be fine.

In some embodiments of the present disclosure, the flexible substrate 1 may be a polypropylene (PP) film, a polyethylene (PE) film, a thermoplastic polyurethane (TPU) elastomer rubber film, a polyamide (PA) film, an ethylene-vinyl acetate copolymer (EVA) film, polyurethane fiber, polyester fiber, a finished hot melt adhesive film, and a flexible film material pre-coated with a resin or an adhesive.

It should be added that, according to actual requirements, flexible electronic devices may also include other electronic components, such as switches, power supplies, light-emitting devices, sensors, chips, and the like, and may also include other layers, such as an encapsulation layer, which are not limited in the embodiments of the present disclosure.

In order to let those skilled in the art understand and implement the flexible conductive paste provided by the embodiments of the present disclosure, some examples are provided as follows.

Example 1

| Composition | Type | dosage (parts) |
|---|---|---|
| Conductive powder 1 | Flake silver powder | 21 |
| Conductive powder 2 | Spherical silver powder | 15 |
| Film former | Resin 1 | 4 |
| Solvent 1 | Ethylene glycol butyl ether acetate | 7 |
| Solvent 2 | Diethylene glycol ethyl ether acetate | 10 |
| Solvent 3 | Diethylene glycol butyl ether acetate | 5 |
| Curing agent | Blocked isocyanate | 2 |
| Liquid metal microcapsule | Self-made gallium indium tin microcapsule | 33 |
| Thixotropic agent | Fumed silica | 0.5 |
| Viscoelastic modifier | High molecular weight acrylic resin solution; Molecular weight: 50000-55000; Solid content: 15% | 1.5 |
| Polar additive | Self-made vinyl chloride-vinyl acetate resin dispersion: Solbin TA5R produced from Nissin; Solid content: 20% | 1 |

Resin 1 is an amorphous saturated polyester resin having a molecular weight of 28,000, a glass transition temperature of −18° C., a viscous flow temperature of 160.4° C., and a hydroxyl value of 4 mg KOH/g.

Example 2

| Composition | Type | dosage (份) |
|---|---|---|
| Conductive powder1 | Flake silver powder | 20 |
| Conductive powder2 | Spherical silver powder | 10 |
| Film former | Resin 2 | 5 |
| Solvent1 | Butyl acetate | 7 |
| Solvent2 | Diethylene glycol ethyl ether acetate | 10 |
| Solvent3 | Methyl isobutyl ketone | 5 |
| Curing agent | blocked isocyanate | 1.0 |
| Liquid metal microcapsule | Self-made gallium indium microcapsule | 30 |
| Thixotropic agent | Hydrogenated castor oil dispersion solution | 0.4 |
| Viscoelastic modifier | High molecular weight acrylic resin solution Molecular weight: 50000-55000; Solid content: 15% | 1.8 |
| Polar additive | Self-made vinyl chloride-vinyl acetate resin dispersion solbin A produced from Nissin; Solid content: 20% | 1 |

Resin 2 is an amorphous saturated polyester resin having a molecular weight of 28,000, a glass transition temperature of −15° C., a viscous flow temperature of 155° C., and a hydroxyl value of 4 mg KOH/g.

Example 3

| Composition | Type | dosage (份) |
|---|---|---|
| Conductive powder 1 | Flake silver powder | 20 |
| Conductive powder 2 | Spherical silver powder | 10 |
| Film former | Resin 2 | 5 |
| Solvent 1 | Propylene glycol butyl ether | 7 |
| Solvent 2 | Diethylene glycol ethyl ether acetate | 10 |
| Solvent 3 | Cyclohexanone | 5 |
| Curing agent | Isocyanate | 1.0 |
| Liquid metal microcapsule | Self-made gallium indium microcapsule | 30 |
| Viscoelastic modifier | High molecular weight polyurethane solution; Molecular weight: 45000-50000; Solid content:15%; | 2 |
| Polar additive | Self-made vinyl chloride-vinyl acetate resin dispersion; solbin M5 produced from Nissin; Solid content: 25% | 1 |

Resin 2 is an amorphous saturated polyester resin having a molecular weight of 28,000, a glass transition temperature of −15° C., a viscous flow temperature of 155° C., and a hydroxyl value of 4 mg KOH/g.

Example 4

| Composition | Type | dosage (份) |
|---|---|---|
| Conductive powder 1 | Flake silver powder | 20 |
| Conductive powder 2 | Spherical silver powder | 1 |
| Film former | Resin 3 | 5 |
| Solvent 1 | Propylene glycol butyl ether | 7 |
| Solvent 2 | Diethylene glycol ethyl ether acetate | 10 |
| Solvent 3 | Cyclohexanone | 5 |
| Curing agent | Isocyanate | 1.0 |
| Liquid metal microcapsule | Self-made gallium indium tin zinc microcapsule | 33 |

-continued

| Composition | Type | dosage (份) |
|---|---|---|
| Viscoelastic modifier | High molecular weight polyurethane solution; Molecular weight: 35000-45000; Solid content: 20%; | 2 |
| Polar additive | Self-made vinyl chloride-vinyl acetate resin dispersion; solbin M5 produced from Nissin; Solid content: 25% | 1 |

Resin 3 is an amorphous saturated polyester resin having a molecular weight of 30,000, a glass transition temperature of −20° C., a viscous flow temperature of 163° C., and a hydroxyl value of 4 mg KOH/g.

Bending Test

| No. | Initial resistance (Ω) | Resistance after being bended 10,000 times (Ω) | Resistance after being bended 50,000 times (Ω) | Resistance after being bended 100,000 times (Ω) |
|---|---|---|---|---|
| Example 1 | 5.2 | 5.8 | 6.3 | 7.1 |
| Example 2 | 4.5 | 4.8 | 5.3 | 5.9 |
| Example 3 | 6 | 6.3 | 6.9 | 7.2 |
| Example 4 | 2.1 | 3.0 | 3.9 | 4.4 |

In the bending test, flexible conductive circuits made by the flexible conductive pastes in the above embodiments are all a strip having a length of 30 cm and a width of 1 mm.

Water-Boiling Test

| No. | Initial resistance (Ω) | Resistance after being boiled for 50 h (Ω) | Resistance after being boiled for 100 h (Ω) | Resistance after being boiled for 200 h (Ω) |
|---|---|---|---|---|
| Example 1 | 5.2 | 5.4 | 5.5 | 5.5 |
| Example 2 | 4.5 | 4.8 | 4.9 | 5.0 |
| Example 3 | 6 | 6.3 | 6.4 | 6.7 |
| Example 4 | 2.1 | 2.2 | 2.1 | 2.4 |

In the boiling test, flexible conductive circuits made by the flexible conductive pastes in the above embodiments are all a strip having a length of 30 cm and a width of 1 mm. The boiling conditions are as follows: 70° C., a neutral lotion with pH=7.

Water-Washing Test

| No. | Initial reading distance (m) | reading distance after being washed 50 times (m) | reading distance after being washed 100 times (m) | reading distance after being washed 200 times (m) |
|---|---|---|---|---|
| Example 1 | 6.2 | 6 | 6 | 6 |
| Example 2 | 6.2 | 6 | 6 | 6 |
| Example 3 | 6.2 | 6.1 | 6 | 5.8 |
| Example 4 | 6.4 | 6.5 | 6.4 | 6.3 |

Water-washing test conditions: 60° C. of water temperature, and 1 h of washing time; laundry equipment: industrial drum washing machine with 100 kg of capacity, 3000 r/min of maximum speed, and 200° C. of drying temperature, and 60 s of drying time.

In the washing test, the antenna in the water-washed electronic tag was made of the flexible conductive paste in the above embodiments. The reading distances were tested after water-washing was performed with different times. The reading distance is pertinent to the antenna and the chip. If the reading distance is not decreased, the resistance variation of the antenna is not significant.

Finally, it should be noted that the technical solutions of the present disclosure are illustrated by the above embodiments, but not intended to limit thereto. Although the present disclosure has been described in detail with reference to the foregoing embodiments, those skilled in the art can understand that the present disclosure is not limited to the specific embodiments described herein, and can make various obvious modifications, readjustments, and substitutions without departing from the scope of the present disclosure.

What is claimed is:

1. A flexible conductive paste, comprising:

3% to 7% by weight of a film former;

20% to 50% by weight of a conductive powder;

25% to 45% by weight of a liquid metal microcapsule;

10% to 30% by weight of a solvent;

0.1% to 5% by weight of a curing agent; and 0.5% to 5% by weight of a functional additive, wherein a wall of the liquid metal microcapsule is a coating resin, a core of the liquid metal microcapsule is a liquid metal, and the liquid metal has a melting point Tm smaller than or equal to T1; the film former has a molecular weight within a range of 15000 to 30000, and has a glass transition temperature Tg smaller than or equal to T1; wherein T1 is a temperature at which a flexible conductive circuit made of the flexible conductive paste is deformed.

2. The flexible conductive paste according to claim 1, wherein the film former is an amorphous polymer.

3. The flexible conductive paste according to claim 1, wherein the film former contains a hydroxyl active group with a hydroxyl value within a range of 3 mg KOH/g to 8 mg KOH/g.

4. The flexible conductive paste according to claim 3, wherein the film former has a viscous flow temperature higher than 120° C.

5. The flexible conductive paste according to claim 4, wherein the film former is a saturated polyester resin having a glass transition temperature lower than −18° C. and a viscous flow temperature higher than 140° C.

6. The flexible conductive paste according to claim 1, wherein the conductive powder is a mixture of a flake silver powder and a spherical silver powder; and a mass ratio of the flake silver powder to the spherical silver powder in the conductive powder is (0.5 to 3):1.

7. The flexible conductive paste according to claim 1, wherein the functional additive comprises one or more of a thixotropic agent, a viscoelastic modifier and a polar additive.

8. The flexible conductive paste according to claim 1, wherein the liquid metal microcapsule has a diameter within a range of 3 μm to 10 μm.

9. The flexible conductive paste according to claim 1, wherein a weight ratio of the coating resin to the liquid metal in the liquid metal microcapsule is within a range of 1:(2 to 10).

10. The flexible conductive paste according to claim 1, wherein a weight ratio of the coating resin to the liquid metal in the liquid metal microcapsule is within a range of 1:(4 to 8).

11. The flexible conductive paste according to claim 1, wherein the liquid metal microcapsule further comprises an organic silicon additive.

12. The flexible conductive paste according to claim 11, wherein a weight ratio of the silicone additive to the coating resin is within a range of 1:(5 to 10).

13. A flexible electronic device, comprising: a flexible substrate and a flexible conductive circuit, wherein the flexible conductive circuit is made of the flexible conductive paste according claim 1.

14. The flexible electronic device according to claim 13, wherein the flexible substrate has a surface tension within a range of 20 mN/m to 50 mN/m.

15. The flexible electronic device according to claim 13, wherein the flexible substrate is a polypropylene film, a polyethylene film, a thermoplastic polyurethane elastomer rubber film, a polyamide film, an ethylene-vinyl acetate copolymer film, polyurethane fiber, polyester fiber, a finished hot melt adhesive film, or a flexible film material pre-coated with a resin or an adhesive.

* * * * *